US005114503A

United States Patent [19]

Yoshizawa et al.

[11] Patent Number: 5,114,503

[45] Date of Patent: May 19, 1992

[54] MAGNETIC CORE

[75] Inventors: Yoshihito Yoshizawa; Kiyotaka Yamauchi, both of Saitama, Japan

[73] Assignee: Hitachi Metals, Inc., Japan

[21] Appl. No.: 29,675

[22] Filed: Mar. 24, 1987

Related U.S. Application Data

[63] Continuation of Ser. No. 736,262, May 21, 1985, abandoned.

[30] Foreign Application Priority Data

May 22, 1984 [JP] Japan ..... 59-103492

[51] Int. Cl.[5] ..... H01F 1/04

[52] U.S. Cl. ..... 148/304; 148/313; 148/315; 336/213; 420/435; 420/436; 420/440; 420/580; 420/581; 420/583; 420/584.1; 420/585; 420/586.1; 420/588

[58] Field of Search ..... 148/304, 403, 313, 315; 336/213; 420/435, 436, 440, 580, 581, 583, 584.1, 585, 586.1, 588

[56] References Cited

U.S. PATENT DOCUMENTS

| | | | |
|---|---|---|---|
| 4,038,073 | 7/1977 | O'Wandley et al. | 148/403 |
| 4,188,211 | 2/1980 | Yamaguchi et al. | 148/403 |
| 4,225,339 | 9/1980 | Inomata et al. | 148/403 |
| 4,411,716 | 10/1983 | Shiiki et al. | 148/403 |
| 4,416,709 | 11/1983 | Ohya et al. | 148/403 |
| 4,420,348 | 12/1983 | Shiiki et al. | 148/403 |
| 4,424,459 | 1/1984 | Inomata et al. | 148/403 |
| 4,439,253 | 3/1984 | Ramanan | 420/435 |
| 4,473,417 | 9/1984 | Inomata et al. | 148/403 |
| 4,504,327 | 3/1985 | Inomata et al. | 148/304 |

FOREIGN PATENT DOCUMENTS

| | | | |
|---|---|---|---|
| 53-113216 | 10/1978 | Japan | 148/403 |
| 59-179751 | 10/1984 | Japan | 148/403 |

*Primary Examiner*—John P. Sheehan

*Attorney, Agent, or Firm*—Antonelli, Terry, Stout & Kraus

[57] ABSTRACT

A magnetic core comprised of an amorphous alloy ribbon wound into a toroidal shape, wherein the said amorphous alloy has a composition of the formula:

$$(Co_{1-x-y-z}Fe_xNi_yMn_z)_{100-a-b-c}M_aSi_bB_c$$

wherein M is at least one element selected from the group consisting of Nb, Cr and Mo, and x, y, z, a, b and c are numbers which satisfy relations of $0<a\leqq 6$, $13\leqq b\leqq 16$, $7\leqq b\leqq 10$, $0<x\leqq 0.1$, $0\leqq y\leqq 0.2$ and $0\leqq x\leqq 0.13$ respectively, said amorphous alloy after heat treatment having a rectangular ratio Br/Bs of at least 80%, a Bs value in a range of 5 KG to 8 KG and a stress relief ratio of at least 75%.

1 Claim, 3 Drawing Sheets

MAGNETIC CORE

This is a divisional of application Ser. No. 736,262, filed May 21, 1985, now abandoned.

BACKGROUND OF THE INVENTION (1) Field of the Invention

The present invention relates to a magnetic core for electronic devices which is composed of a Co-base amorphous alloy ribbon wound into a toroidal shape. More particularly, it relates to a magnetic core which suffers only low core loss during its operation.

(2) Description of the Prior Art

Because of recent development of electronic devices, switching power sources carrying a magnetic amplifier have been being used more and more widely used. A main portion constituting a magnetic amplifier is a saturable reactor comprising a magnetic core including a metal ribbon wound into a toroidal shape. Magnetic core materials provided with a high saturation flux density Bs and a high rectangular ratio Br/Bs where Br represents a residual magnetic flux density are now desired to use for cores of the saturable reactors in switching power sources. Heretofore, there have been used 50% Ni-Permalloys, 80% Ni-Permalloys, etc. But these alloys fail to meet the recent high frequency requirements of switching power sources which have increasingly high performance with reduced size and weight. Specifically, 50% Ni-Permalloys and 80% Ni-Permalloys suffer enormous core loss when these alloys are used in a high frequency magnetic field. Consequently, magnetic core materials excellent in high frequency characteristics have been required.

A proposal has been made to provide a magnetic core comprising a heat-treated Co-base amorphous alloy ribbon wound into a toroidal shape to overcome the above-stated disadvantages of 50% Ni-Permalloys and 80% Ni-Permalloys. One may refer to U.S. Pat. No. 4,473,417. One method of heat treatments applied to Co-base amorphous alloy is to quench it after keeping it at a temperature higher than its Curie temperature (Tc).

Although amorphous alloys processed by the above heat treatment may have a low initial core loss, such alloys suffer a low rectangular ratio (Br/Bs), and a big disaccommodation of core loss. As a result, saturable reactors made of such materials have a tendency to become uncontrollable because of excessive heat generation which also cause undesirable effects on the neighboring elements in a switching power source.

It was also proposed to treat a Co-base amorphous alloy ribbon at a temperature below its Curie temperature where the alloy remains magnetic, from the aspect that a Co-base amorphous alloy is easily provided with an inductive magnetic anisotropy, because an amorphous state is a metastable state metallurgically. In the above-mentioned case, an amorphous metal alloy ribbon having a low core loss is produced by a rapid quench of a melt, then heat-treated at a temperature below its Curie temperature in a magnetic field in order to enhance its rectangular ratio Br/Bs.

However, it was recently recognized that a toroidal core comprised of an amorphous alloy which was heat-treated by the above-mentioned method has a big rectangular ratio and a small disaccommodation of core loss, but the core loss thereof is bigger than those of amorphous alloy heat-treated at a temperature above its Curie temperature.

Now, a toroidal core comprised of an amorphous metal ribbon provided with better characteristics than those of the previous cores is desired. Before this invention, it of the generally believed core is desired. Before this invention, it was the general idea that a Co-base amorphous metal provided with a high rectangular ratio (Br/Bs) has a big core loss, although it has a small disaccommodation of core loss, and on the contrary one provided with a low rectangular ratio (Br/Bs) has a big disaccommodation of core loss although it has a small core loss, and it was difficult to obtain a material without these drawbacks.

OBJECT AND SUMMARY OF THE INVENTION

Accordingly, it is the object of the present invention to present an improved amorphous metal core with a high rectangular ratio (Br/Bs), a small core loss and a small disaccommodation of core loss.

According to this invention, there is provided a magnetic core comprised of an amorphous alloy ribbon formed into a toroidal. The composition of the amorphous metal can be described by the formula, $$(Co_{1-x-y-z}Fe_xNi_yMn_z)_{100-a-b-c}M_aSi_bB_c$$

where M is at least one element selected from the group consisting of Nb, Cr and Mo, and x, y, z, a, b and c are numbers which satisfy relations of $0<a\leqq 6$, $13\leqq b\leqq 16$, $7\leqq c\leqq 10$, $0<x\leqq 0.1$, $0\leqq y\leqq 0.2$, and $0\leqq z\leqq 0.13$, respectively. The amorphous alloy has a rectangular ratio Br/Bs of at least 80% , a saturation magnetic flux density Bs of 5KG to 8KG and a stress relief ratio of at least 75% .

DESCRIPTION OF THE PREFERRED EMBODIMENTS

Figure 1:
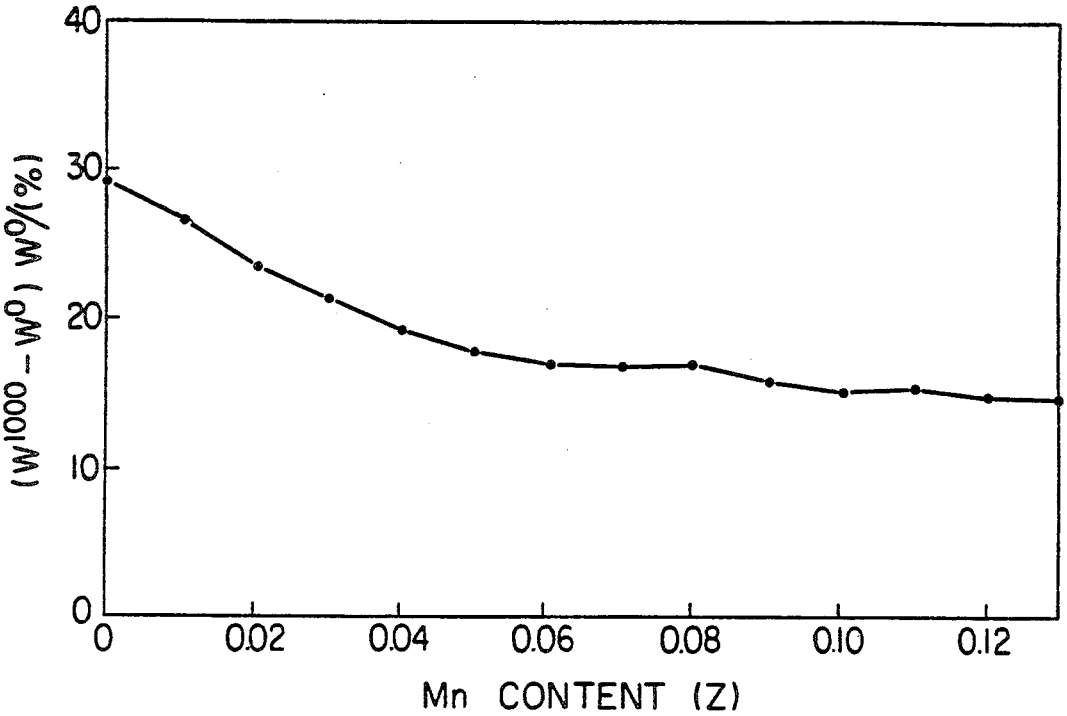
FIG. 1 is a graph showing the effect of Mn on a disaccommodation of core loss of a core comprised of an amorphous alloy having a composition formula, $$(Co_{0.975-z}Fe_{0.024}Mn_zNi_{0.001})_{75}Mo_{0.5}Cr_{0.5}Si_{15}B_9;$$

It is stated that a stress relief ratio in this invention is represented by the ratio ro/r where ro is the curvature of the most outside ribbon bound in a core shape and r is the curvature of the most outside ribbon when it is put into a free state. On the other hand, a disaccommodation ratio of core loss means (W )/ Wo, where Wo is the initial value of core loss measured in a 100-KHz alternating magnetic field which induces a maximum flux value of 25G, and means the core loss measured 1000 hours later.

The following are the reasons for the composition formula of the amorphous metal alloy utilized in cores in this invention.

The total amount of Si and B should fall within the range between 18 to 30 atomic % . If the total amount of Si and B is less than 18 atomic % , it is rather difficult to make the alloy in an amorphous state, but if the amount is more than 30 atomic % , the alloy does not have a sufficiently high magnetic flux density. The Si is effective to reduce a core loss of an alloy, but the addition of excess Si causes a low Curie temperature and a low rectangular ratio (Br/Bs). The Si content falls within the rang of between 13 to 16 atomic % to obtain preferable characteristics of alloys. The B content should fall within the range of between 7 to 10 atomic % , because it is rather difficult to produce an alloy in an amorphous state if the B content is less than 7 atomic % , on the other hand the alloy would be provided a low ma9netic flux density if the B content in the alloy exceeds 10 atomic % .

In our amorphous alloy, a small amount of C, P, Ge or Al or mixture thereof can be included without any introduction of any serious drawback into the alloy, if the total amount of these elements is less than 5 atomic % .

The total amount of Co, Fe, Ni and Mn should fall within the range of about 68 to 82 atomic % , because it is difficult to obtain the alloy in an amorphous state if the amount exceeds 82 atomic % , and because it would have a low magnetic flux density if the amount is less than 68 atomic In this invention, the combination of Co with Fe and Ni causes the high rectangular ratio because of an induced magnetic anisotropy by a heat treatment in a magnetic field and cooling thereafter.

The Mn content is defined by z in the heretofore described formula. As shown in FIG. 1, the Mn addition causes a reduction of a disaccomodation ratio, but an excess addition makes the resulting alloy brittle. The preferable value of z should be equal to or less than 0.13. In FIG. 1, the disaccommodation of core loss depends on z-value which represents the Mn content in the alloy having a composition formula:

$$(Co_{0.975-z}Fe_{0.024}Mn_zNi_{0.001})_{75}Mo_{0.5}Cr_{0.5}Si_{15}B_9$$

comprising the magnetic core in this invention.

The M element which represents one of a mixture of Nb, Cr and Mo can enhance the magnetic stability and other properties of the alloy, but the amount of M is preferably equal to or less than 6 atomic % because the addition of excess M causes undesirable drawbacks.

Figure 2:
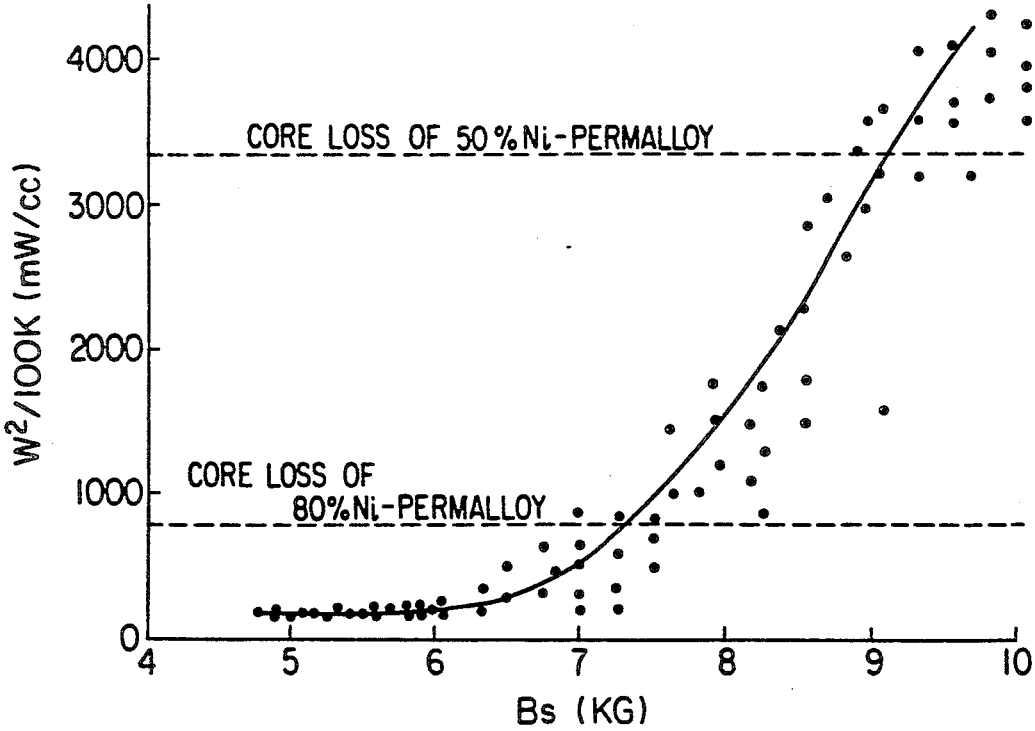
FIG. 2 is a graph showing a relationship of a core loss W2/100K and a saturation flux density Bs of a Co-base amorphous metal.

The core comprised of a Co-base amorphous alloy has a core loss value depending on a saturation flux density as shown in FIG. 2, where W2/100K (mW/CC) represents a core loss measured in an 100KHz of alternating magnetic field to induce a 2-KG of maximum flux density in the alloy. A core having a saturation flux density of less than 5KG is not proper for an actual application because of its low Curie temperature and poor thermal characteristics. As an ordinary core comprised of a ferrite is provided with about 4 to 5KG of saturation flux density, the amorphous alloy in the core of this invention should be provided with a saturation flux density of 5KG or more. On the other hand, a core loss increases as a saturation flux density increases. From a practical point of view, the upper limit of saturation flux density is about 8KG, because the core loss increases as the saturation flux density increases and it is undesirable for an amorphous alloy in this invention to have a much higher core loss than about 800 mW/cc core loss of 80% Ni-Permalloy.

Since an amorphous alloy according to this invention having a saturation flux density of 7 to 8KG can also have as which satisfies the formula: $|\lambda s| \leqq 1\times10^6$, it is useful in a reactor operated by 50 to 100KHz of alternating magnetic field because in such high frequency field the core loss of the alloy is about half the core loss of 50% Ni-Permalloy which is about 3400 mW/cc. Moreover, the Co-base amorphous alloy having a saturation flux density Bs of 5 to 7KG and a magnetostriction λs which satisfies the formula: $|\lambda s| \leqq 1\times10^{-6}$ can be used in a core having a lower core loss than that of 80% Ni-Permalloy when it is operated in an alternating magnetic field of as high as 100KHz frequency.

The range of the rectangular ratio Br/Bs is limited to 80% or more because it is difficult to obtain the reduction of disaccommodation of core loss when the rectangular ratio Br/Bs is lower than 80% .

The present invention will be explained below on the basis of Examples.

EXAMPLE 1

The amorphous metal ribbons of various compositions were produced by a single-roll method from their melts. Their compositions are shown in Table 1. Each of the ribbons was formed into a toroidal core of 5mm in height, 25mm in outer diameter and 20mm in inner diameter.

TABLE 1

| Alloy composition (at %) | Br/Bs (%) | Stress relief ratio (%) | $(W_{1000}-W_o)/w_o$ (%) |
|---|---|---|---|
| $(Co_{0.918}Fe_{0.005}Mn_{0.077})_{76}Si_{15}B_9$ | 93 | 95 | 22 |
| $(Co_{0.918}Fe_{0.005}Mn_{0.077})_{75.7}Si_{15}B_9Nb_{0.3}$ | 95 | 93 | 15 |
| $(Co_{0.914}Fe_{0.021}Mn_{0.065})_{74}Mo_1Si_{16}B_9$ | 85 | 90 | 40 |
| $(Co_{0.94}Fe_{0.06})_{71}Cr_1Si_{18}B_{10}$ | 82 | 85 | 45 |
| $(Co_{0.85}Fe_{0.05}Ni_{0.1})_{75}W_1V_1Si_{12}B_{11}$ | 95 | 96 | 10 |
| $(Co_{0.91}Mn_{0.09})_{76.5}Ta_1Ti_1Si_{13}B_{8.5}$ | 92 | 94 | 25 |
| $(Co_{0.93}Fe_{0.02}Mn_{0.03}Ni_{0.02})_{76}Zr_1Hf_1Si_{14}B_8$ | 90 | 93 | 14 |
| $(Co_{0.95}Ni_{0.05})_{73}Cu_1Ag_1Si_{13}B_{12}$ | 89 | 92 | 13 |
| $(Co_{0.94}Fe_{0.01}Mn_{0.05})_{76}Au_{0.5}Sm_{0.5}Si_{14}B_9$ | 91 | 90 | 10 |
| $(Co_{0.95}Fe_{0.05})_{74.8}Nd_{0.1}Ce_{0.1}Si_{10}B_{15}$ | 88 | 88 | 12 |

Afterward, each of the obtained cores was subjected to a heat-treatment at a temperature between a crystallization temperature (Tx) and a Curie temperature (Tc), to relax the stress, and then to a heat treatment at a temperature less than the Curie temperature by about 50° C. in a magnetic field in the direction of the magnetic path of the core.

Table 1 shows the characteristics of the cores which were produced as mentioned above. A disaccommodation of core loss was measured at 50° C. in a thermostatic chamber, for simulating the actual conditions of the switching power source.

As shown in Table 1, the cores according to this invention were provided with a 50% or less of disaccommodation ratio of core loss in contrast with the conventional cores having a 150 to 450% of disaccommodation ratio of core loss.

EXAMPLE 2

An amorphous metal ribbon was produced by casting a melt having a composition formula: $(Co_{0.918}Fe_{0.005}Mn_{0.077})_{75.7}Si_{15}B_9Nb_{0.3}$ by a single-roll method. The obtained ribbon was cut to make 5m30cm length of pieces each of which was wound to a core having a shape of outer diameter 19mm x Inner diameter 15mm x Height mm. Each core was heat-treated for stress relaxation and then heated in a magnetic field under various conditions. The characteristics of the obtained cores are shown in FIG. where D, E and F indicate respectively 75% , 80% and 97% of stress relief ratio. We showed the experimental results of rectangular ratio Br/Bs, core loss WZ/100K, (mW/cc) and a temperature rise of a core (A) having 97% of stress relief ratio in this invention and a core (B) which has not been heat-treated for a stress relaxation.

Figure 3:
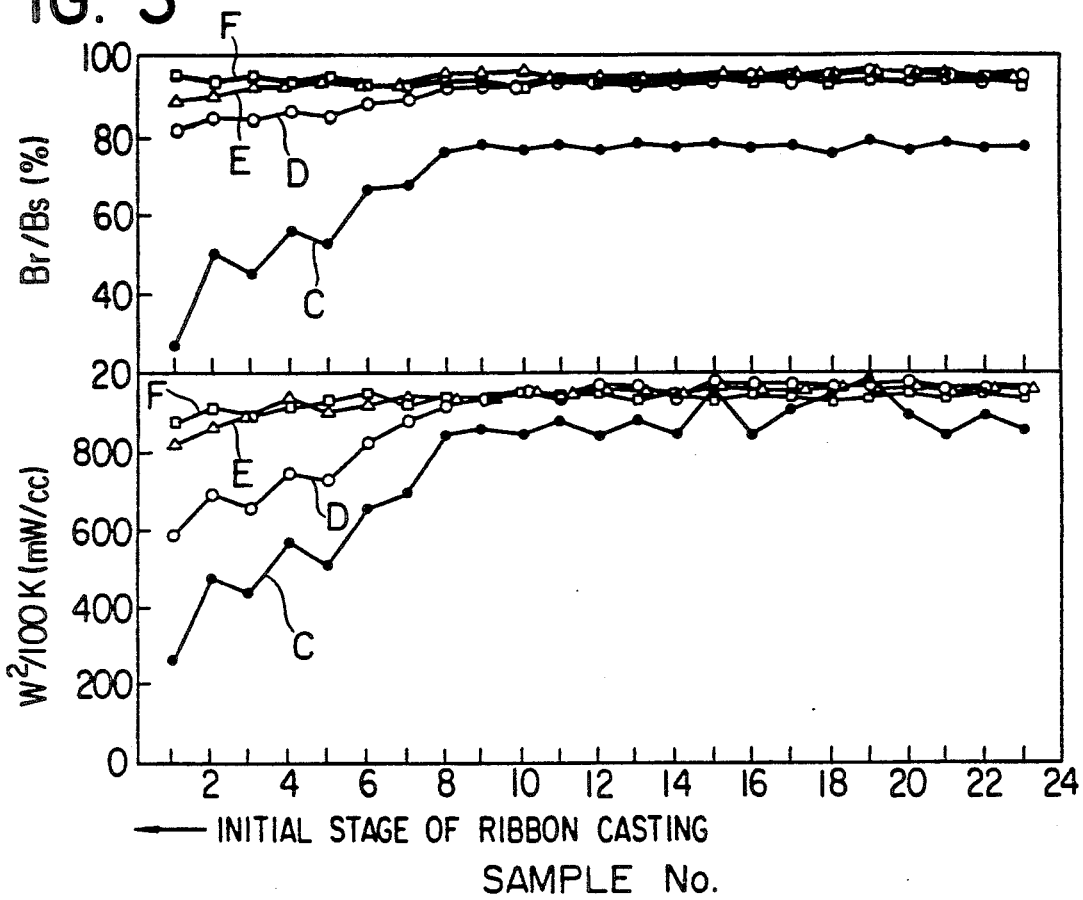
FIG. 3 is a graph showing a core loss W2/100K dependence and a rectangular ratio dependence on the casting stage along the longitudinal direction of the ribbons C, D, E and F where C, D, E and F, respectively indicate a core without stress relief treatment, a core with 75% of stress relief ratio, a core with 80% of stress relief ratio and a core with 97% of stress relief ratio.
Figure 4:
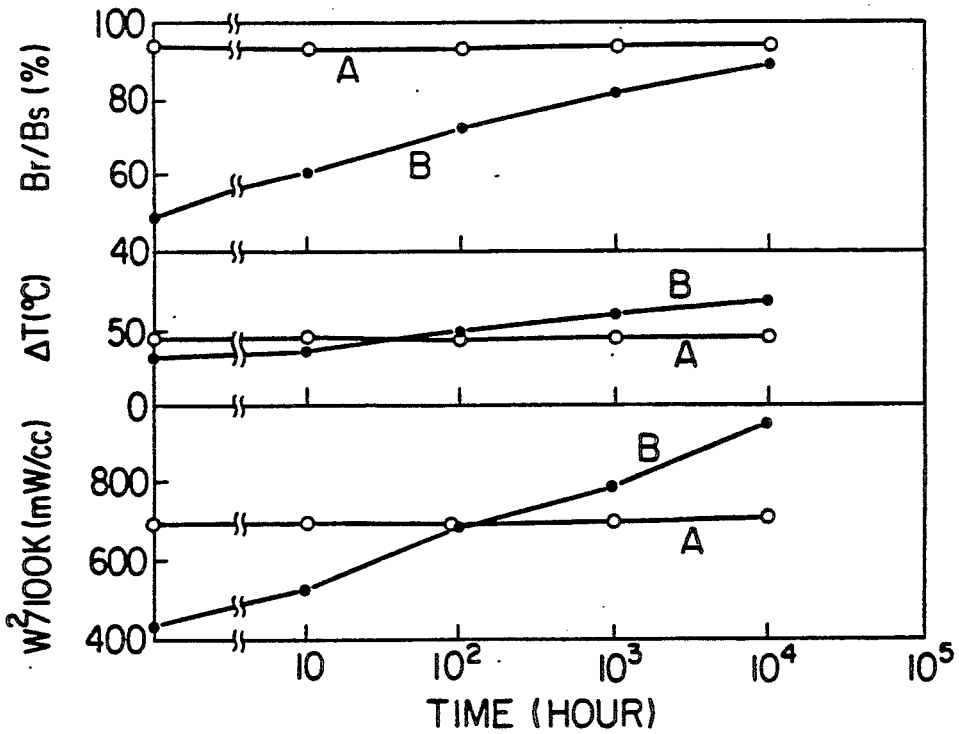
FIG. 4 shows a graph showing a rectangular ratio (Br/Bs) dependence, a core loss dependence, and a temperature rise of a core of this invention (A) and a core of prior art (B)

As shown in FIG. 3, a core provided with a stress relaxation ratio of 75% or more has a large rectangular ratio Br/Bs and a low core loss. A core having a stress relaxation ratio of 80% or more has a larger rectangular ratio and a small multilation of these values taken along a longitudinal direction of the ribbon.

Although a core which has not been heat-treated for a stress relaxation has as large disaccommodation of core loss as 100% after 1000 hours, the cores in this invention have almost the same core loss as the initial value even after 1000 hours.

The cores having a 75% or more of stress relief ratio are provided with a small disaccommodation of core loss and their characteristics are independent of the casting stage of the ribbon.

EXAMPLE 3

Figure 5:
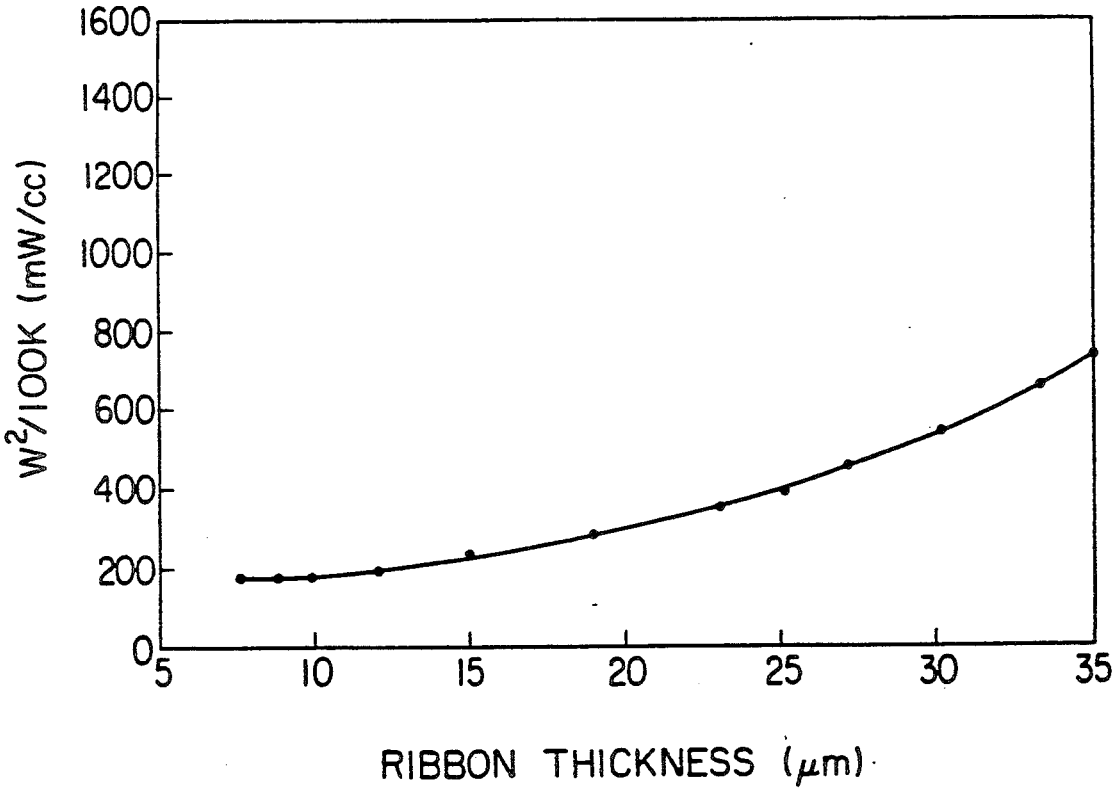
FIG. 5 shows a graph showing a relation between the core loss W2/100K and the ribbon thickness of an amorphous metal in this invention.

Amorphous metal ribbons of various thicknesses were produced by a casting from a melt having a composition formula: $(Co_{0.945}Fe_{0.025}Mn_{0.03})_{73}M_{0.5}Si_{13}B_9$. Each of the ribbons was wound to a core of outer diameter 20mm×inner diameter 15mm×height 5mm. The wound cores were heat-treated in a short time at 400° C. to be provided with 95 to 98% of stress relief ratio and then treated at a temperature lower than Curie temperature to enhance a rectangular ratio Br/Bs in a magnetic field. FIG. 5 shows the experimental results of the core loss depending on the ribbon thickness. As seen from FIG. 5, an amorphous metal ribbon having a thickness of more than 25 μm is not proper for a core, because of a large core loss, especially for a reactor driven by as high frequency as 100KHz of alternating magnetic field.

It is preferable that the ribbon is provided with 25 μm or less thickness in this invention.

In consequence, the toroidal core according to this invention is provided with a high rectangular ratio, and a low disaccommodation of core loss and it is useful for a reactor component to be driven by a high frequency magnetic field in a switching power source.

What is claimed is:

1. A magnetic core comprising an amorphous alloy ribbon wound into a torodial shape having a composition of the formula:

$$(Co_{1-x-y-z}Fe_xNi_yMn_z)_{100-a-b-c}M_aSi_bB_c$$

wherein M is at least one element selected from the group consisting of Nb, Cr and Mo, and x, y, z, a, b and c are numbers which satisfy relations of $0<a\leqq 6$, $13\leqq b\leqq 16$, $7\leqq c\leqq 10$, $0<x\leqq 0.1$, $0\leqq\leqq y\leqq 0.2$ and $0\leqq z\leqq 0.13$ respectively on condition of $18<a+b+c+<32$ and $18\leqq b+c\leqq 30$, wherein said magnetic core has a rectangular ratio Br/Bs of at least 80%, a Bs value in a range of 5KG to 8KG and a stress relief ratio of at least 75% causing a low disaccommodation of core loss, after a heat-treatment of the core at a temperature between a crystallization temperature (Tx) and a Curie temperature (Tc) for stress realization, and a subsequent heat-treatment at a temperature of less by about 50° C. than the Curie temperature in a magnetic field, the direction of which is substantially coincident with the direction of the magnetic path of the core.

* * * * *